United States Patent [19]

Schäfer et al.

[11] Patent Number: 4,951,853

[45] Date of Patent: Aug. 28, 1990

[54] REFRACTORY PLATE ASSEMBLY FOR A SLIDING CLOSURE UNIT

[75] Inventors: Herbert Schäfer, Weisbaden; Rodolph Strohmayer, Marktredwitz, both of Fed. Rep. of Germany

[73] Assignee: Didier-Werke AG, Wiesbaden, Fed. Rep. of Germany

[21] Appl. No.: 403,488

[22] Filed: Sep. 6, 1989

[30] Foreign Application Priority Data

Sep. 15, 1988 [DE] Fed. Rep. of Germany ..... 3831386

[51] Int. Cl.[5] ..... B22D 41/34

[52] U.S. Cl. ..... 222/600; 222/597

[58] Field of Search ..... 222/590, 591, 597, 600; 266/236, 285

[56] References Cited

U.S. PATENT DOCUMENTS

| | | | |
|---|---|---|---|
| 3,970,283 | 7/1976 | Hind | 222/600 |
| 4,597,514 | 7/1986 | Thrower | 222/600 |
| 4,717,128 | 1/1988 | Brückner et al. | 222/600 |
| 4,842,172 | 1/1989 | Kleinevoss et al. | 222/600 |

FOREIGN PATENT DOCUMENTS 2409699 9/1974 Fed. Rep. of Germany .

*Primary Examiner*—S. Kastler

*Attorney, Agent, or Firm*—Wenderoth, Lind & Ponack

[57] ABSTRACT

A refractory plate assembly for use in a sliding closure unit includes a sheet metal shell including a base portion and an integral peripheral portion. A refractory plate member having a sliding surface is positioned within the shell. Positioning or support structure locates the plate member within the interior of the shell, and fiber or granular thermal insulation material is positioned within the shell between the base portion thereof and the refractory plate member.

23 Claims, 2 Drawing Sheets

FIG. 1
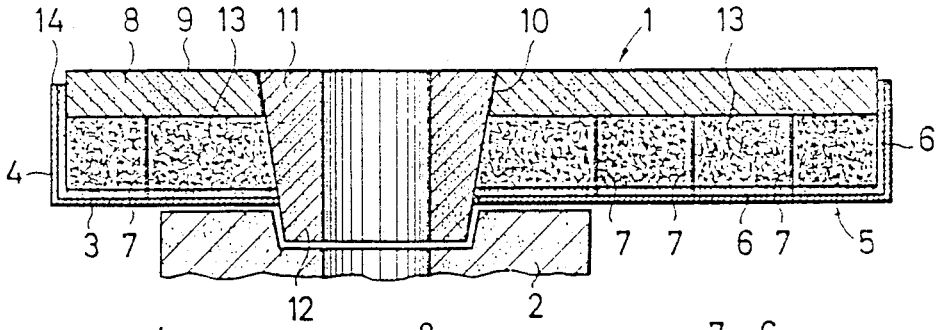
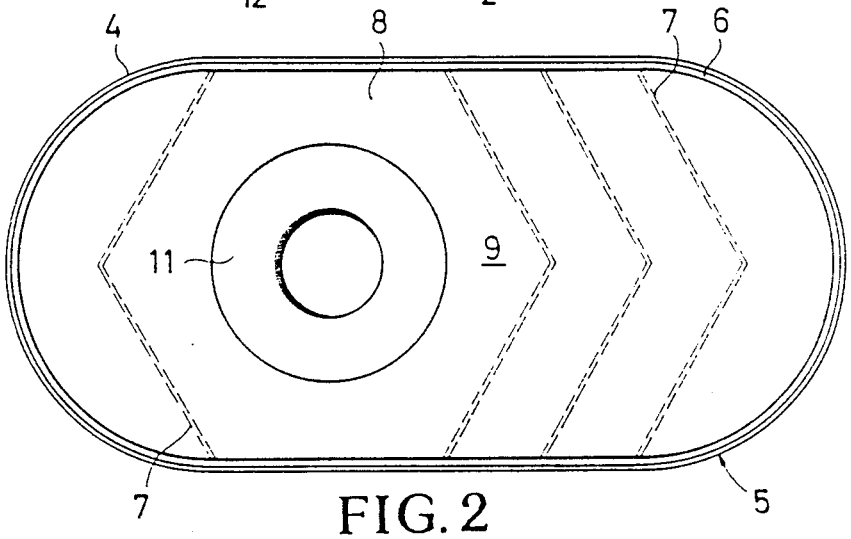
FIG. 2
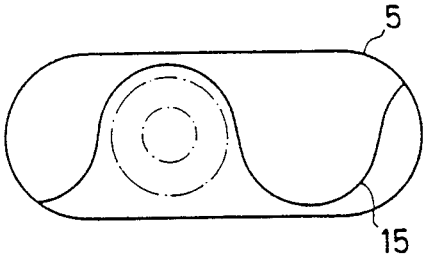
FIG. 3
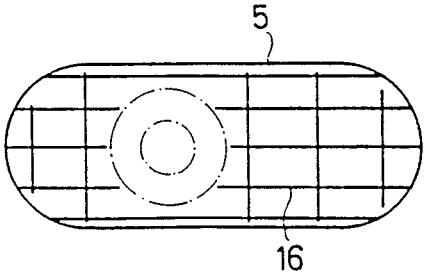
FIG. 4

REFRACTORY PLATE ASSEMBLY FOR A SLIDING CLOSURE UNIT

BACKGROUND OF THE INVENTION

The present invention relates to a refractory plate assembly for use in a sliding closure unit employable in controlling the discharge of molten metal from a metallurgical vessel. The present invention particularly relates to such an assembly of the type including a refractory plate having a planar sliding surface and mounted within a jacket or shell, for example formed of sheet metal, with an insulation material therebetween. The present invention even more particularly relates to such an assembly also including a refractory outlet sleeve or tube joined to the refractory plate member and extending therefrom through a base portion of the shell.

In this type of refractory plate assembly, i.e. so-called two-component plates, known for example from DE-AS 24 09 699, the object generally is to achieve a maximum service life of the assembly and at the same time to employ the smallest possible amounts of high-grade and expensive wear-resistant refractory materials that form the sliding surface. That is, the sliding surface generally must be formed of an expensive high-grade refractory material, such as an oxide ceramic. For reasons of economy however it is desired to form the portions of the assembly that do not contact the molten metal with a less expensive low-grade refractory material, such as refractory concrete which has a low density and thus acts as a thermal insulator with respect to the refractory plate member defining the sliding surface. However, the use of such different refractory materials in this prior art manner has a number of inherent disadvantages, primarily involved in production. Particularly, molding of the plate member defining the sliding surface directly into refractory concrete involves a difficult drying or curing process in order to attempt to prevent the occurrence of stress in the refractory concrete backing material.

SUMMARY OF THE INVENTION

With the above discussion in mind, it is an object of the present invention to provide an improved refractory plate assembly whereby it is possible to overcome the above and other prior art disadvantages.

It is a more particular object of the present invention to provide such a refractory plate assembly whereby it is possible to employ simple and inexpensive insulating materials by use of simple engineering techniques making production relatively easy, while at the same time to improve the refractory plate assembly with respect to performance and ease of manufacture.

These objects are achieved in accordance with the present invention by the provision that the refractory plate assembly includes a shell or jacket, for example formed of sheet metal, including a base portion and an integral peripheral portion. A refractory plate member having a sliding surface is positioned within the metal shell by supporting or positioning means, and granular or fiber insulation material is positioned within the shell between the base portion thereof and the refractory plate member. By means of this relatively simple construction the refractory plate member essentially is locked in the shell by the peripheral portion thereof, and the shell supports the insulation material between the base portion of the shell and the refractory plate member. As a result, very substantial functional advantages are achieved since the means for supporting, positioning and/or holding the refractory plate member within the shell are uncomplicated, particularly with regard to construction. Further and very importantly, flexible or loose insulation material can be employed without any special requirements. It is possible to achieve a very desirable insulating effect, and this limits the amount of expensive high-grade wear-resistant refractory material necessary for the plate member having the sliding surface. On the other hand, it is possible to maintain the necessary safety performance of the assembly and the necessary service life thereof. Even further, the assembly of the present invention provides the very important advantage that it remains internally stress-free since it has a structure that avoids the creation of stress-induced destructive cracks within the refractory material.

A positioning or support means may include at least one support member extending vertically or transversely from the base portion of the shell. The plate member is supported within the shell by at least one support member, with at least one space defined between the plate member and the base portion, and with the insulation material filling such space. The plate member may rest directly on the support member. The support member may in the form of at least one web that may be rigidly fixed to the shell or loosely positioned therein. Particularly, the web may be elastic and may have opposite ends resiliently abutting the peripheral portion of the shell without rigid attachment thereto. The web may have a sinusoidal configuration, or there may be provided a plurality of webs that are spaced from each other, such webs having various possible configurations, such as chevron configurations. The webs also may be arranged in a preassembled or fixed grid-like configuration that may be loosely positioned within the shell or that may be attached thereto. Furthermore, the shell may have an internal lining of a thermally resistant material, for example a thermally stable mat material or a foil material. All of the above various web configurations, as well as obvious modifications thereof, can be achieved and manufactured with very little effort.

Also, the positioning or supporting means may be in the form of at least one projection, for example a plurality of beads or a peripherally continuous bead, extending inwardly from the peripheral portion of the shell, with the plate member being supported by the projection and with a space defined between the plate member and the base portion, the insulation material filling such space.

In accordance with a further feature of the present invention, the positioning or supporting means may in the form of a separate plate-shaped member positioned above the base portion of the shell and extending across the interior thereof. Thus, the base portion of the shell and this plate-shaped member essentially form a double-bottom of the shell. The insulation material is located between the base portion and the plate-shaped member. The plate-shaped member is located above the base portion of the shell and spaced therefrom by various support means. The refractory plate member is embedded within a layer of refractory mortar laid on the plate-shaped member.

In accordance with a further feature of the present invention, the insulation material is in the form of a plate, for example a mineral fiber plate, positioned below the refractory plate member, such two elements then being held together as a unit by a peripheral tensioning ring. This unit then is embedded within the layer of refractory mortar within the shell.

In all embodiments of the present invention it is possible to line the interior of the shell with a thin thermal insulating liner, such as a thermally resistant mat or foil material, thereby to achieve an additional insulating effect.

BRIEF DESCRIPTION OF THE DRAWINGS

Other objects, features and advantages of the present invention will be apparent from the following description of preferred embodiments thereof, with reference to the accompanying drawings, wherein:

FIG. 1 is a longitudinal cross sectional view of a refractory plate assembly for use in a linearly movable sliding closure unit in accordance with one embodiment of the present invention;

FIG. 2 is a plan view of the assembly of FIG. 1;

FIGS. 3 and 4 are schematic plan views showing variations of the embodiment of FIGS. 1 and 2.

DETAILED DESCRIPTION OF THE INVENTION

Figure 5:
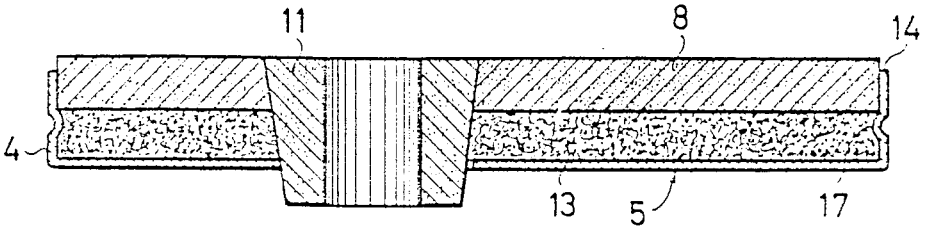
FIGS. 5–7 are views similar to FIG. 1 but of other embodiments of the present invention.

In FIG. 1 there is shown a refractory plate assembly 1 intended to be employed as a movable or stationary plate of a linearly movable sliding closure unit. Element 2 is a partially illustrated discharge or inlet sleeve to be mounted, in a known manner, to the assembly 1. Refractory plate assembly 1 includes an outer sheet metal jacket or shell 5 that includes a bottom or base portion 3 and an integral peripheral portion 4. Shell 5 is lined with a thermally resistant lining 6, for example of mat or foil material. Extending upwardly from base portion 3 are a plurality of positioning means in the form of chevron-shaped webs 7 on which rests a refractory plate 8 that defines a sliding surface 9 of the assembly. Plate 8 has therethrough an opening 10 into which fits a refractory outlet sleeve 11 that extends from the plate 8 outwardly through base portion 3 of shell 5. It is contemplated that plate 8 and sleeve 11 will be made of a relatively expensive highly wear-resistant ceramic material, such as an oxide ceramic, since these elements are subject to wear and erosion during use of the sliding closure unit. Sleeve 11 may be mortared within plate 8 or otherwise attached thereto in a known manner. Sleeve 11 has an end surface that is flush with sliding surface 9, for example achieved by a grinding operation. Sleeve 12 has a lower projecting end defining a base 12 for connection to sleeve or tube 2.

Between plate 8 and base portion 3 of the shell is defined a space, or rather a plurality of spaces between webs 7 that are filled with a thermal insulation material 13, for example of granular or fiber form. Particularly advantageous is a mineral fiber insulation material 13 filled between the webs 7 and the. periphery of the shell. Webs 7 may be rigidly attached to the shell, but in a particularly preferred arrangement indicated in FIGS. 1 and 2, webs 7 are elastic and have a configuration to enable opposite ends of the webs to be resiliently abutted with spaced sides of the peripheral portion of the shell. Thus, webs 7 essentially are internally stressed between the opposite sides of the peripheral portion of the shell. This makes it very easy to position and mount the webs, as well as the plate 8. After filling the spaces between the webs 7 with the mineral fibers 13, the prefinished component including plate 8 and sleeve 11 is fitted into shell 5 in such a manner that the sliding surface 9 is located above an upper edge 14 of the peripheral portion 4 of the shell, with the peripheral portion firmly enclosing and surrounding the plate 8. During use of the refractory plate assembly 1, there is achieved an excellent insulating effect with respect to plate 8 and sleeve 11. Thus, elements 8, 11 can be designed to be relatively thin, thereby employing less of the expensive wear-resistant refractory material, while still achieving the desired service life.

FIG. 3 schematically illustrates a modification of the embodiment of FIGS. 1 and 2, wherein the chevron-shaped plural webs 7 are replaced by at least one web 15 having an undulatory or sinusoidal configuration. It is contemplated that web 15 also be positioned within shell 5 in an internally stressed manner, i.e. that it be elastic with opposite ends resiliently abutting spaced portions of the peripheral portion 4 of the shell.

FIG. 4 also schematically illustrates a modification of the embodiments of FIGS. 1–3, wherein a plurality of spaced longitudinal webs and spaced transverse webs are preassembled to form a support member in the form of a grid 16 that is positioned within shell 5. This grid structure may be mounted within the shell by internally stressing webs of the grid, but preferably is positioned within the shell without being internally stressed and is attached, for example by spot welding, to the shell.

The embodiment of FIG. 5 shows a simplified structure wherein the plate 8 is supported within the shell by at least one projection such as a plurality of peripherally spaced beads or a single annular bead 17 extending inwardly from peripheral portion 4 of shell 5 and extending parallel to upper peripheral edge 14 thereof. There thus is defined between the base portion of the shell and the plate 8 a space that is filled with the thermal insulation material, such as mineral fibers 13.

Figure 6:
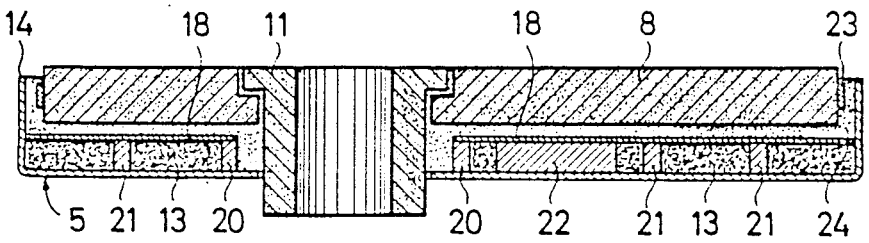

On the other hand, the embodiment of FIG. 6 offers a more stable structure. Thus, a plate-shaped member 18 is positioned above the base portion of the shell and essentially defines therewith a double bottom of the shell. Member 18 is supported in a spaced manner from the base portion of the shell by support elements, for example an annular strip 20 spaced outwardly of sleeve 11, as well as a suitable number of transverse strips 21 and any necessary longitudinal strips 22. The thermal insulation material 13 is positioned in the space or spaces between the base portion of the shell and member 18. Plate 8 is embedded within a layer 24 of mortar, for example refractory mortar. Mortar 24 is filled into a space from inwardly of ring 20, extending upwardly between plate 8 and sleeve 11 and horizontally over the top of member 18, and then upwardly around the outer periphery of plate 8 to a level even with the upper peripheral edge of the shell. FIG. 6 also shows another feature of the present invention wherein the sleeve 11 may have an upper radially outwardly extending flange that fits within a complimentary recess in plate 8. Preferably an annular rim or ring 23 surrounds the outer periphery of plate 8 to hold the material thereof together in the event that the plate becomes cracked during use of the assembly.

Figure 7:
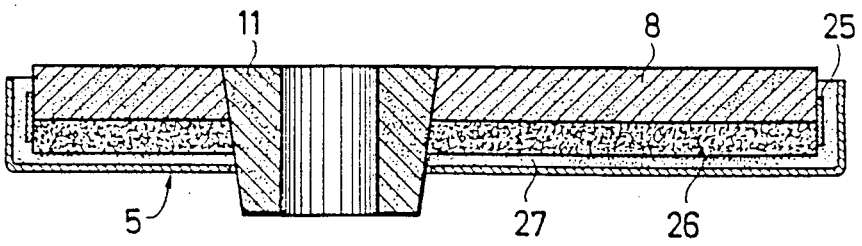

FIG. 7 shows an embodiment of the present invention that is of somewhat similar construction. Thus, the insulation material is in the form of a plate 26, for example a mineral fiber plate that is positioned below refractory plate 8 and that is held together therewith by a peripheral rim or ring 25 similar to ring 23 of FIG. 6. This unit of refractory plate 8 and insulation plate 26 is embedded within a layer 27 of mortar, for example refractory mortar. Thus, the unit of plates 8, 26 is anchored to the interior of the shell.

The concept of the present invention is applicable to movable plate or to fixed or stationary bottom plates of sliding closure units. Furthermore, the concept of the present invention is applicable to refractory plate assemblies for use in sliding closure units of the rotary type or the swivel type in addition to the illustrated and described linear type.

Although the present invention has been described and illustrated with respect to preferred features thereof, it is to be understood that various modifications and changes may be made to the specifically described and illustrated features without departing from the scope of the present invention.

We claim:

1. A refractory plate assembly for use in a sliding closure unit, said assembly comprising:

a shell including a base portion and an integral peripheral portion;

a refractory plate member having a sliding surface and positioned within said shell;

means within said shell for positioning within the interior thereof said plate member, said positioning means comprising at least one support member extending substantially transversely from said base portion of said shell, said plate member being supported within said shell by said at least one support member with at least one space defined between said plate member and said base portion; and fiber or granular insulation material positioned within said shell between said base portion thereof and said plate member.

2. An assembly as claimed in claim 1, further comprising a refractory sleeve member extending through said plate member and projecting therefrom through said base portion of said shell.

3. An assembly as claimed in claim 2, wherein said sleeve member has an end surface coplanar with said sliding surface of said plate member.

4. An assembly as claimed in claim 1, wherein said shell is of metal.

5. An assembly as claimed in claim 1, wherein said shell is of sheet metal.

6. An assembly as claimed in claim 1, wherein said plate member directly rests on said at least one support member.

7. An assembly as claimed in claim 1, wherein said at least one support member comprises at least one web.

8. An assembly as claimed in claim 7, wherein said at least one web is rigidly fixed to said shell.

9. An assembly as claimed in claim 7, wherein said at least one web is elastic and has opposite ends resiliently abutting said peripheral portion of said shell without rigid attachment thereto.

10. An assembly as claimed in claim 7, wherein said at least one web has a sinusoidal configuration.

11. An assembly as claimed in claim 7, comprising plural said webs spaced from each other.

12. An assembly as claimed in claim 11, wherein said plural webs are of chevron configuration.

13. An assembly as claimed in claim 7, comprising plural said webs arranged in a grid configuration.

14. An assembly as claimed in claim 1, further comprising a thermally resilient material lining the interior of said shell.

15. A refractory plate assembly for use in a sliding closure unit, said assembly comprising:

a shell including a base portion and an integral peripheral portion;

a refractory plate member having a sliding surface and positioned within said shell;

means within said shell for positioning within the interior thereof said plate member, said positioning means comprising at least one projection extending inwardly from said peripheral portion of said shell, said plate member being supported by said projection with a space defined between said plate member and said base portion; and fiber or granular insulation material positioned within said shell and filling said space between said base portion thereof and said plate member.

16. A refractory plate assembly for use in a sliding closure unit, said assembly comprising:

a shell including a base portion and an integral peripheral portion;

a refractory plate member having a sliding surface and positioned within said shell;

means within said shell for positioning within the interior thereof said plate member, said positioning means comprising a plate-shaped member positioned above said base portion and extending across the interior of said shell, said plate member being supported above said plate-shaped member; and fiber or granular insulation material positioned within said shell between said base portion thereof and said plate-shaped member.

17. An assembly as claimed in claim 16, further comprising support means on said base portion and spacing said plate-shaped member therefrom.

18. An assembly as claimed in claim 16, further comprising a layer of refractory mortar supporting said plate member above said plate-shaped member.

19. An assembly as claimed in claim 18, wherein said plate member is embedded in said refractory mortar.

20. A refractory plate assembly for use in a sliding closure unit, said assembly comprising:

a shell including a base portion and an integral peripheral portion;

a refractory plate member having a sliding surface and positioned within said shell;

fiber or granular insulation material positioned within said shell between said base portion thereof and said plate member, said insulation material being in the form of a plate positioned below said plate member; and means within said shell for positioning within the interior thereof said plate member, said positioning means comprising a layer of refractory mortar mounting said plate of insulation material and said plate member within said shell.

21. An assembly as claimed in claim 20, wherein said plate of insulation material comprises a mineral fiber plate.

22. An assembly as claimed in claim 20, wherein said plate of insulation material and said plate member are embedded within said refractory mortar.

23. An assembly as claimed in claim 20, wherein said plate member and said plate of insulation material are held together as a unit by a peripheral ring.

* * * * *